US005110166A

United States Patent [19]

Brown

[11] Patent Number: 5,110,166

[45] Date of Patent: May 5, 1992

[54] SAFETY LOCK FOR A CRANKED WINDOW

[76] Inventor: Wilbur N. Brown, 652 Devonshire Dr., Oxnard, Calif. 93030

[21] Appl. No.: 659,891

[22] Filed: Feb. 25, 1991

[51] Int. Cl.[5] ..... E05C 17/12

[52] U.S. Cl. ..... 292/262; 292/DIG. 33

[58] Field of Search ..... 292/262, 275, 276, 289, 292/DIG. 33; 29/526

[56] References Cited

U.S. PATENT DOCUMENTS

| | | | |
|---|---|---|---|
| 1,744,158 | 1/1930 | Carswell | 292/DIG. 33 X |
| 2,072,083 | 3/1937 | Campbell | 292/DIG. 33 X |
| 2,194,287 | 3/1940 | Marsh | 292/275 X |
| 2,702,205 | 2/1955 | Germain | 292/275 X |
| 2,980,945 | 4/1961 | Hollar, Jr. | 292/275 X |

*Primary Examiner*—Richard E. Moore
*Attorney, Agent, or Firm*—Daniel L. Dawes

[57] ABSTRACT

Cranked windows can be retrofitted with a locking system which prevents their forced entry by burglars while still permitting the windows to be opened by a predetermined amount to allow ventilation. Such a retrofitted locking system comprises a case-hardened bolt to disposed through aligned bores drilled through overlapping flanges on a movable fame of the cranked window and the corresponding stationary frame. The bores are drilled through the overlapping flanges at a position in the frames opposite a hinge about which the movable frame rotates. The bores are drilled with a diameter slightly larger than the diameter of the bolt disposed through them to permit the bolt to be inclined, thereby allowing a predetermined degree of opening of the frames relative to each other. An integral head portion of the bolt is disposed outside the movable frame, while the opposing threaded portion of the bolts is provided with a pair of cinched nuts to act as a stop. The bolt has a predetermined length which limits the degree of opening of the window, but prohibits any opening sufficient to allow a burglar to attempt to grasp the pair of cinched nuts to loosen them or otherwise use a tool to do so.

20 Claims, 1 Drawing Sheet

10
12
14
15
16
18
20
22
24
28
30
32
34
36
38
40

SAFETY LOCK FOR A CRANKED WINDOW

BACKGROUND OF THE INVENTION

1. Field of the Invention

The invention relates to the field of locking devices for windows and in particular to a locking device which allows a cranked window to be opened for ventilation but prevents forced entry.

2. Description of the Prior Art

One of the popular historical designs for metal windows includes a window that is hinged on a side and cranked open and shut by a hand cranked gear mechanism provided at the base of the window interior to the dwelling or structure. A crank handle is rotated either clockwise or counterclockwise to drive a conventional gear mechanism which rotates the window on its hinge. There is sufficient mechanical advantage in the gear mechanism such that only a small amount of cranking force is required to rotate the window open and shut, even if there is substantial friction or drag in the rotation of the window. Furthermore, the mechanical advantage is great enough that the gear mechanism acts as a locking device for the window. Under ordinary circumstances the window cannot be pried open to any significant extent, because of the locking action provided by the high gear ratio of the mechanism. Therefore many owners simply rely on this mechanical advantage as the sole lock on the windows notwithstanding that a separate locking latch may be provided.

However, while the gear mechanism cannot be turned by normal forces applied to the window, someone attempting to make forced entry through such a window can do so by using a crowbar or similar tool to apply an excessive force to the gear mechanism such that the gear teeth are simply stripped or the gears themselves broken. The mechanical latch, even when used, can also be forced or broken by such excessive forces. Once the gear mechanism and latch are stripped or broken, the window can often then be easily opened and entry obtained.

While a large number of conventional locking mechanism can be used to provide additional security for such windows, such mechanisms typically require the window to be shut in order to be engaged. The particular advantage of these windows, namely that they can be rotated open and shut by varying amounts to provide desired ventilation, is thereby defeated when such additional latches or locking mechanisms are employed.

Therefore what is needed is a simple, and inexpensive mechanism which can be retrofitted to cranked windows without the requirements of special tools or skills, which provide a high degree of security similar to that provided by conventional latching mechanisms, but which do not prevent operation of the window for purposes of providing ventilation.

BRIEF SUMMARY OF THE INVENTION

The invention is a security lock for a cranked window having a movable frame and stationary frame with flange portions. The invention comprises a first bore defined through the flange portion of the movable frame. A second bore is defined through the flange portion of the stationary frame. A mechanism, described in greater detail below, is disposed through the first and second bore for limiting movement of the movable frame relative to the stationary frame. As a result, the cranked window may be opened to provide ventilation while prohibiting forced entry through the window.

The mechanism of limiting the movement of the movable frame relative to the stationary frame comprises a case-hardened bolt disposed through the first and second bores. The case-hardened bolt has a fixed and integral head. The head is disposed exterior to the movable frame. The case-hardened bolt has a threaded end and further comprises a pair of nuts threaded to the threaded end and tightened against each other to form a stop. The first and second bores have a diameter greater than the case-hardened bolt by a predetermined amount to permit inclination of the bolt with respect to the movable frame and stationary frame. In the illustrated embodiment the case-hardened bolt is 4" in length or less. In any case it is preferred that the case-hardened bolt has a length which limits opening of the movable frame relative to the stationary frame by more than approximately 2¼".

In another embodiment the movable frame rotates on a hinge defining a radius of curvature and wherein the case-hardened bolt is curved to approximate the radius of curvature.

The invention is also characterized as a locking system for a window comprising a fixed frame, a movable frame, and a hinge coupled to the movable frame about which the movable frame rotates. The movable frame is rotatable into and out of closure with the fixed frame. A mechanism is retrofitted to the movable frame and fixed frame for limiting rotation of the movable frame relative to the fixed frame. As a result, the movable frame and fixed frame may be opened to permit ventilation while further forced rotation of the movable frame is prohibited to prevent forced entry through the window.

The movable frame and fixed frame each have a rigid periphery with an extending flange. The flanges extend toward each other so that the flanges are overlapping. The retrofitted mechanism couples the overlapping flanges together to permit restricted relative rotation of the flange of the movable frame relative to the flange of the fixed frame.

The locking system further comprises a gear mechanism coupled between the movable frame and fixed frame for selectively rotating the movable frame relative to the fixed frame. The retrofitted mechanism is mechanically independent from the gear mechanism so that forced failure of the gear mechanism leaves the retrofitted mechanism unaffected.

The retrofitted mechanism is disposed through the overlapping flanges opposing the hinge. The retrofitted mechanism comprises a nonextensible linking member having a stop provided at each end. The nonextensible linking member is disposed at one end through the movable frame and at opposing end through the fixed frame. The stops at the corresponding ends are disposed outside of the overlapping flanges to prohibit movement of the movable frame and fixed frame from each other by more than a predetermined maximum amount without interfering with movement less than the maximum amount.

The nonextensible member is a rigid strap. The rigid strap is preferably a bolt having a head at one end providing one of the stops and a pair of cinched nuts at an opposing end providing the other one of the stops. Preferably, the rigid strap is straight.

In another embodiment the movable frame is characterized by a radius of curvature about the hinge and the rigid strap has a curvature approximating the radius of curvature of the movable frame.

The invention is also a method of retrofitting a cranked window having a movable frame and a fixed frame to prevent forced entry therethrough while still permitting ventilation. The method comprises the steps of providing a bolt having a head in a threaded end. A pair of nuts are threaded into the bolt and cinched against each other to form a stop. A first hole is bored through a first flange on the movable frame opposite a hinge to which the movable frame is connected and about which the movable frame rotates. A second hole is bored through the fixed frame and is aligned with the first hole. The first and second holes each have a diameter larger than the bolt by a predetermined amount to permit slight inclination of the bolt either in the first or second hole. The bolt is disposed through the first and second holes with the head of the bolt exterior to the movable frame. The pair of nuts on the threaded end of the bolt are cinched together to form a stop. The bolt has a length no greater than a predetermined maximum.

The illustrated invention and its various embodiments can better be visualized by now turning to the following drawings wherein like elements are referenced by like numerals.

Figures 1, 2, 3:
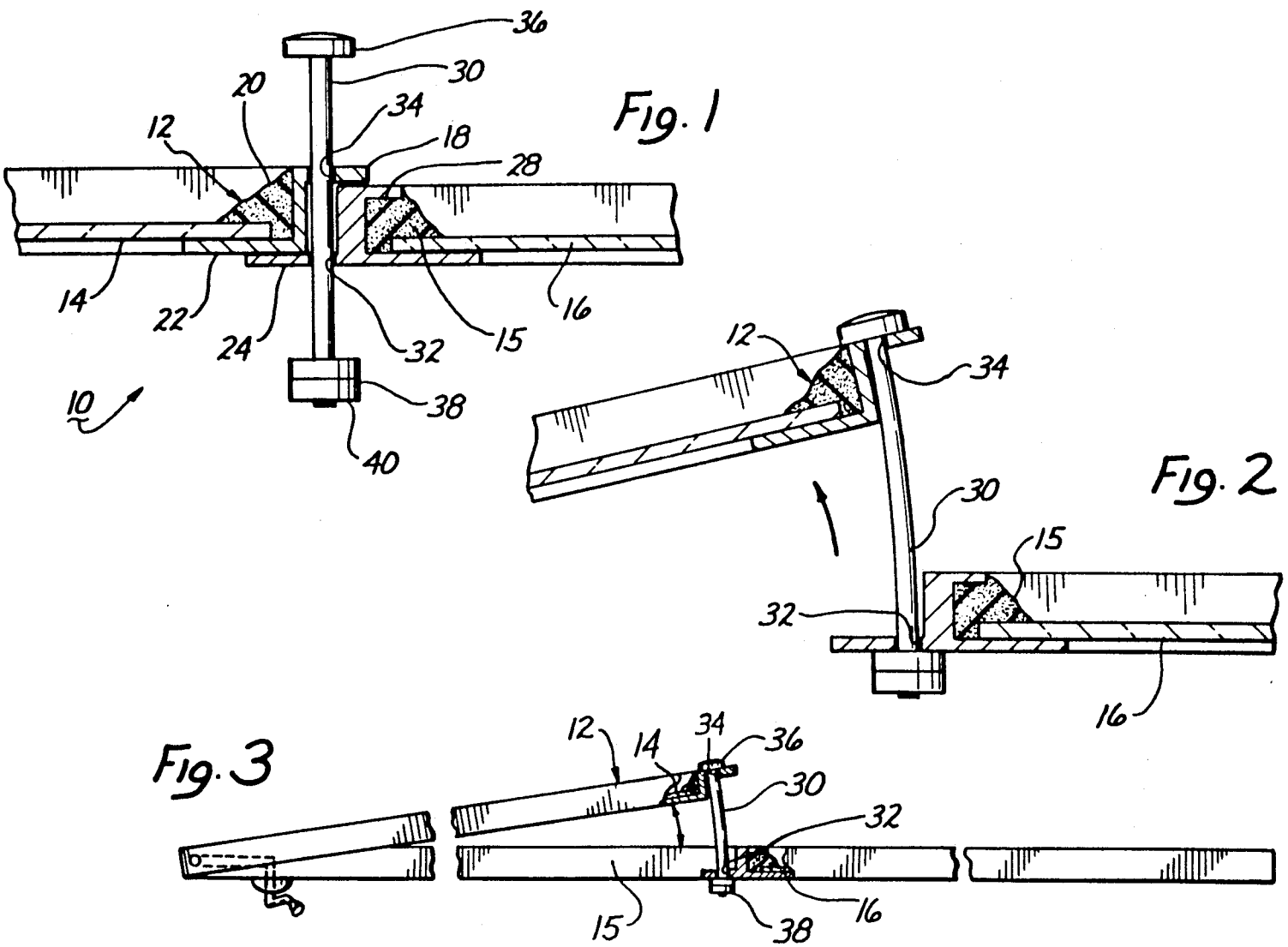
FIG. 1 is a cross-section of the invention shown when the window is shut.
FIG. 2 is a cross-section of the invention shown with the window partially open.
FIG. 3 is a cross-sectional view in reduced scale showing a curved safety lock installed in a gear cranked window.

The invention and its various embodiments may be better understood by now turning to the following detailed description.

DETAILED DESCRIPTION OF PREFERRED EMBODIMENTS

Cranked windows can be retrofitted with a locking system which prevents their forced entry by burglars while still permitting the windows to be opened by a predetermined amount to allow ventilation. Such a retrofitted locking system comprises a case-hardened bolt to disposed through aligned bores drilled through overlapping flanges on a movable fame of the cranked window and the corresponding stationary frame. The bores are drilled through the overlapping flanges at a position in the frames opposite a hinge about which the movable frame rotates. The bores are drilled with a diameter slightly larger than the diameter of the bolt disposed through them to permit the bolt to be inclined, thereby allowing a predetermined degree of opening of the frames relative to each other. An integral head portion of the bolt is disposed outside the movable frame, while the opposing threaded portion of the bolts is provided with a pair of cinched nuts to act as a stop. The bolt has a predetermined length which limits the degree of opening of the window, but prohibits any opening sufficient to allow a burglar to attempt to grasp the pair of cinched nuts to loosen them or otherwise use a tool to do so.

FIG. 1 is a cross-sectional view of a portion of a cranked window, generally indicated by reference numeral 10, in which the invention has been installed. The window is depicted in a closed configuration. Window 10 is comprised of a movable or rotatable metal frame 12 in which glazing 14 is retained by conventional means. Frame 12 of window 10 is set within a stationary window frame 15 attached to the structure, or forming fixed window framing for additional fixed glazing 16 as depicted in FIG. 1.

In the illustrated embodiment, the edge of movable frame 12 forms in cross-section a straightened Z-shape having an outer horizontal leg 18, an integrally connected vertical leg 20, and an inner horizontal leg 22. Movable frame 12 fits into stationary frame 15 which typically has a T-shaped cross-section. Stationary frame 15 in the illustrated embodiment has a rear base flange 24, a thickened vertical leg 26 integrally formed with base flange 24, and a horizontal outer flange 28. The inside surfaces, as viewed from the interior of the structure of legs 18–22 of movable frame 12 loosely nest or mate with a portion of the exterior surfaces of stationary surfaces 15 comprised of base flange 24, vertical leg 26, and exterior leg 28.

However, in almost all instances, a predetermined amount of clearance is provided between vertical leg 20 of movable frame 12 and vertical leg 26 of stationary frame 15. Very often this clearance will be provided with conventional weather stripping and in ordinary circumstances provides a labyrinthine seal against outside weather elements.

The clearance between legs 20 and 26 is generally sufficient to allow disposition between legs 20 and 26 of a ¼" diameter machine bolt 30. A bore is drilled through flange 24 of stationary frame 15 just to the left of vertical leg 26. In the same operation, an opposing bore 34 is drilled through horizontal flange 18 of movable frame 12. Bores 32 and 34 are approximately aligned and slightly oversized with respect to the diameter of bolt 30. For example, if bolt 30 is ¼" bolt, bores 32 and 34 are approximately 5/16" in diameter.

Bores 32 and 34 may be drilled through frame 12 and 15 either above or below the locking latch normally provided in the frame. Bolt 30 is inserted through bores 32 and 34 such that the integrally formed hex head 36 is positioned on the outside of the structure. The opposing end of bolt 30 is provided with a pair of nuts 38 and 40 which are tightened against each other to form a stop.

Window 10 may now be cranked open and closed in the conventional manner allowing window 10 to open to the extent of the length of bolt 30. For example in the illustrated embodiment where ¼" diameter bolt is provided through 5/16" bores 32 and 34, a 4" case-hardened bolt can easily be employed to allow at least 2¼" opening of window 10.

As window 10 opens, movable frame 12 rotates outwardly as seen in FIG. 2 and begins to become inclined relative to the plane of fixed frame 15. The slight play of bolt 30 in bores 32 and 34 permits bolt 30 to be inclined both with respect to fixed frame 15 and movable frame 12, thereby allowing an increased degree of opening. Bores 32 and 34 can be enlarged as long as the structural integrity of bores 32 and 34 in frames 12 and 15 respectively are not jeopardized by making the surrounding metal too thin. Even greater enlargements of the window opening can be realized by lengthening bolt 30. However, in the illustrated embodiment, a 4" bolt which allows a 2¼" opening is ideal in that it restricts the opening and thereby prevents a burglar from inserting his hand or arm through the opening to degree sufficient to reach cinched nuts 38 or 40, or to apply any tool for loosening them. As a practical matter, if a burglar cannot quickly and easily open a window and encounters difficulties and impediments such as the invention provides, the burglar will abandon his attempt to force entry and flees.

Although bolt 30 is shown in the illustrated embodiment as loosely disposed into the window frames, it is also contemplated that it may be resiliently fixed therein by the use of rubber bushings or washers and nut combinations if weatherproofing of bores 32 and 34 are required.

Many alterations and modifications may be made by those having ordinary skill in the art without departing from the spirit and scope of the invention. For example, although a rigid case-hardened bolt 30 has been depicted in the illustrated embodiment, it is to be expressly understood that bolt 30 may be rigidly or resiliently curved as shown in dotted outline to match the radius of curvature of movable frame 12 about its opposing hinge to allow for easier and freer opening. However, the degree of opening must be limited in order to prohibit exterior access. Further, although a bolt has been described, it is expressly contemplated that an armored cable with appropriate end fittings to serve the same function as the bolt hex head and cinched nut pair could be used. In that case the bore holes could be made more nearly the same diameter as the armored cable, since rotation of the window would be allowed by the flexibility of the armored cable. In addition one end of the armored cable could be fixed if desired to one of the window frames for preferred positioning of the cable.

It must also be understood that the frame cross sectional shapes and dimensions are only illustrative and that many other types of frame configurations could be accommodated in a manner consistent with the spirit and scope of the invention.

Therefore it must be understood that the illustrated embodiment has been set forth only for the purposes of clarity and example and should not be taken as limiting the invention as defined by the following claims. The following claims are to be understood not only what is literally described but all equivalent means for performing substantially the same function to obtain substantially the same result in substantially the same way.

I claim:

1. A security lock for a cranked window having a movable frame and stationary frame with flange portions comprising:

a first bore defined through said flange portion of said movable frame;

a second bore defined through said flange portion of said stationary frame; and a substantially rigid nonextensible means disposed through said first and second bore for limiting movement of said movable frame relative to said stationary frame, whereby said cranked window may be opened to provide ventilation while prohibiting forced entry through said window.

2. A security lock for a cranked window having a movable frame and stationary frame with flange portions comprising:

a first bore defined through said flange portion of said movable frame;

a second bore defined through said flange portion of said stationary frame; and means disposed through said first and second bore for limiting movement of said movable frame relative to said stationary frame, wherein said means of limiting said movement of said movable frame relative to said stationary frame comprises a case-hardened bolt disposed through said first and second bores, whereby said cranked window may be opened to provide ventilation while prohibiting forced entry through said window.

3. The lock of claim 2 wherein said case-hardened bolt has a fixed and integral head, said head being disposed exterior to said movable frame.

4. The lock of claim 3 wherein said case-hardened bolt has a threaded end and further comprises a pair of nuts threaded to said threaded end and tightened against each other to form a stop.

5. The lock of claim 2 wherein said first and second bore have a diameter greater than said case-hardened bolt by a pre-determined amount to permit inclination of said bolt with respect to said movable frame and stationary frame.

6. The lock of claim 2 wherein said case-hardened bolt is 4" in length or less.

7. The lock of claim 2 wherein said case-hardened bolt has a length which limits opening of said movable frame relative to said stationary frame by more than approximately 2¼".

8. The lock of claim 2 wherein said movable frame rotates on a hinge defining a radius of curvature and wherein said case-hardened bolt is curved to approximate said radius of curvature.

9. The lock of claim 6 wherein said movable frame rotates on a hinge defining a radius of curvature and wherein said case-hardened bolt is curved to approximate said radius of curvature.

10. The lock of claim 7 wherein said movable frame rotates on a hinge defining a radius of curvature and wherein said case-hardened bolt is curved to approximate said radius of curvature.

11. A locking system for a window comprising:

a movable frame;

a hinge coupled to said movable frame about which said movable frame rotates;

a fixed frame, said movable frame being rotatable into and out of closure with said fixed frame; and a substantially rigid nonextensible retrofitted means coupled to said movable frame and fixed frame for limiting rotation of said movable frame relative to said fixed frame, whereby said movable frame and fixed frame may be opened to permit ventilation while further forced rotation of said movable frame is prohibited to prevent forced entry through said window.

12. The locking system of claim 11 wherein said movable frame and fixed frame each have a rigid periphery with an extending flange, said flange extending from said fixed frame towards said movable frame, and said flange extending from said movable frame toward said fixed frame so that said flanges are overlapping, and wherein said retrofitted means couples said overlapping flanges together to permit a restricted relative rotation of said movable frame relative to said fixed frame.

13. The locking system of claim 12 further comprising a gear mechanism coupled between said movable frame and fixed frame for selectively rotating said movable frame relative to said fixed frame, said retrofitted means being mechanically independent of said gear mechanism so that forced failure of said gear mechanism leaves said retrofitted means unaffected.

14. The locking system of claim 11 wherein said retrofitted means is disposed through said overlapping flanges opposing said hinge.

15. The locking system of claim 14 wherein said retrofitted means comprises a nonextensible linking member having a stop provided at each end, said nonextensible linking member being disposed through said movable frame and through said fixed frame, said stop at said corresponding ends disposed outside of said overlapping flanges to prohibit movement of said movable frame and fixed frame from each other by more than a predetermined maximum amount without interfering with movement of said movable frame and fixed frame relative to each other less than said maximum amount.

16. A locking system for a window comprising:

a movable frame;

a hinge coupled to said movable frame about which said movable frame rotates;

a fixed frame, said movable frame being rotatable into and out of closure with said fixed frame; and retrofitted means coupled to said movable frame and fixed frame for limiting rotation of said movable frame relative to said fixed frame, wherein said retrofitted means is disposed through said overlapping flanges opposing said hinge;

wherein said retrofitted means comprises a nonextensible linking member having a stop provided at each end, said nonextensible linking member being disposed through said movable frame and through said fixed frame, said stop at said corresponding ends disposed outside of said overlapping flanges to prohibit movement of said movable frame and fixed frame from each other by more than a predetermined maximum amount without interfering with movement of said movable frame and fixed frame relative to each other less than said maximum amount, wherein said nonextensible member is a rigid strap, whereby said movable frame and fixed frame may be opened to permit ventilation while further forced rotation of said movable frame is prohibited to prevent forced entry through said window.

17. The locking system of claim 16 wherein said rigid strap is a bolt having a head at one end, providing one of said stops, and a pair of cinched nuts at an opposing end, providing said other one of said stops.

18. The locking system of claim 16 wherein said rigid strap is straight.

19. The locking system of claim 16 wherein said movable frame is characterized by a radius of curvature about said hinge and wherein said rigid strap has a curvature approximating said radius of curvature of said movable frame.

20. A method of retrofitting a cranked window having a movable frame and a fixed frame to prevent forced entry therethrough while still permitting ventilation comprising the steps of:

providing a bolt having a head and a threaded end;

providing a pair of nuts adapted to the threaded on said threaded end of said bolt and cinched against each other to form a stop;

boring a first hole through a first flange on said movable frame opposite a hinge to which said movable frame is connected and about which said movable frame rotates;

boring a second hole through said fixed frame aligned with said first hole, said first and second holes having a diameter larger than said bolt by a predetermined amount to permit slight inclination of said bolt either in said first or second hole;

disposing said bolt through said first and second hole with said head of said bolt exterior to said movable frame; and threading said pair of nuts on said threaded end of said bolt to cinch said nuts together to form a stop, said bolt having a length no greater than a predetermined maximum.

* * * * *